US006092789A

United States Patent [19]

Christopher et al.

[11] Patent Number: 6,092,789

[45] Date of Patent: Jul. 25, 2000

[54] METHODS AND APPARATUS FOR BOOM HOIST SYSTEMS

[75] Inventors: Patrick Christopher, Paramus, N.J.; Daniel R. Juneau, Huntington Beach, Calif.; Herman J. Schellstede, New Iberia, La.

[73] Assignees: Hugo Nev Corporation, New York, N.Y.; Joint Venture Operations, Inc., Portland, Oreg.

[21] Appl. No.: 09/044,117

[22] Filed: Mar. 19, 1998

[51] Int. Cl.[7] ..... B66D 5/26; B66D 1/58; B66D 5/02

[52] U.S. Cl. ..... 254/274; 188/106 P; 188/70 R; 254/267; 254/361; 254/377; 254/379; 303/2; 303/3; 212/284

[58] Field of Search ..... 212/284; 254/274, 254/267, 361, 377, 378, 379; 188/106 P, 77 R, 77 W, 82.77, 70 R, 71.1; 303/2, 3

[56] References Cited

U.S. PATENT DOCUMENTS

| | | | |
|---|---|---|---|
| 4,187,681 | 2/1980 | Johnson | 254/361 |
| 4,278,298 | 7/1981 | Sauka et al. | 303/3 |
| 4,598,829 | 7/1986 | Young et al. | 212/284 |
| 4,950,125 | 8/1990 | Gravenhorst | 254/379 |
| 5,314,289 | 5/1994 | O'Leary | 414/494 |
| 5,343,134 | 8/1994 | Wendt et al. | 318/757 |
| 5,353,895 | 10/1994 | Camack et al. | 187/369 |
| 5,423,438 | 6/1995 | Swanson | 212/275 |
| 5,424,435 | 6/1995 | Gregory | 188/77 W |
| 5,603,420 | 2/1997 | Swanson | 212/274 |
| 5,647,577 | 7/1997 | Feldman et al. | 254/378 |
| 5,671,912 | 9/1997 | Langford et al. | 254/267 |

*Primary Examiner*—Katherine A. Matecki
*Attorney, Agent, or Firm*—Fish & Neave; Michael E. Shanahan

[57] ABSTRACT

A boom hoist system for supporting and adjusting the position of a lifting crane gantry is provided including a drum, a drive system, and first and second braking systems for selectively stopping rotation of the drum. The boom hoist system operates independently from crane mechanical works and the first and second braking systems may include sensors for automatically engaging when specified conditions occur in order to prevent a hoisted gantry from falling uncontrollably in the event of a hoist system malfunction or failure.

24 Claims, 9 Drawing Sheets

METHODS AND APPARATUS FOR BOOM HOIST SYSTEMS

BACKGROUND OF THE INVENTION

The present invention relates to improvements for boom hoist systems used in the operation of lifting cranes, and more particularly, to methods and apparatus for preventing a hoisted gantry from uncontrollably falling after hoist system failure.

Boom hoist systems are used to support and adjust the position of the spanning framework structure or gantry that provides mechanical advantage to lifting cranes. This is typically accomplished by a wire cable that attaches to a portion of a gantry at one end and couples to the drum of a hoist system at the other end. The weight of the gantry is supported by the wire cable attached to the hoist drum. When the gantry is maintained in a given position, the drum is locked in place by a brake to prevent the weight of the gantry from unwinding wire cable from the drum. If desired, the position of the gantry may be adjusted by rotating the hoist drum and altering the length of the wire cable supporting the gantry. Rotational power is supplied to the drum by a mechanical drive train that connects to the primary motor of the crane. When adjustment of the gantry is desired, the motor rotates the drum through the drive train causing the wire cable either to accumulate on or to dispense from the drum, thus raising or lowering the gantry so that the crane may be adjusted to a wide range of positions at varying degrees of leverage. In conventional systems, the weight of the gantry is dynamically supported through the drive train of the primary motor and held in place by a separate holding brake applied to the drive train near the motor.

One problem with this type of system is that a failure of the motor, holding brake, or drive train can cause a hoisted gantry to become unsupported and drop uncontrollably. This problem is further complicated by the sudden and unpredictable nature of such failures which leaves the crane operator with insufficient time to react to the problem. In the past, conventional systems have failed catastrophically causing complete destruction of the gantry and jeopardizing the safety of support personnel.

It would therefore be desirable to provide boom hoist systems with adequate security features to prevent such failures. It would also be desirable to provide a boom hoist system that is not dependent upon a mechanical drive train for support and rotational power. It would be additionally desirable to provide a boom hoist system with an independent fail-safe braking system to ensure continued support for a hoisted gantry in the event of a hoist system malfunction or failure.

SUMMARY OF THE INVENTION

It is therefore an object of the present invention to provide more secure methods and apparatus for supporting and adjusting the gantry of a lifting crane.

It is another object of this invention to provide methods and apparatus that prevent a hoisted gantry from falling uncontrollably.

It is another object of this invention to provide a boom hoist system which operates independently of the mechanical drive train of a lifting crane.

It is a further object of this invention to provide a boom hoist system with a redundant independent emergency braking system that will engage automatically in case of a primary system malfunction or failure to ensure that a hoisted gantry will not drop uncontrollably.

These and other objects of the invention are accomplished in accordance with the principles of the present invention by providing a boom hoist system with redundant independent braking systems that operate separately from the mechanical works of the lifting crane (i.e., the mechanical drive train and other mechanical assemblies within the crane). This eliminates hoist system dependence upon a mechanical drive train for support and power and also provides a dedicated emergency braking system to ensure support for hoisted gantry in the event of a hoist system malfunction or failure.

The boom hoist system of the present invention includes a drum and a wire cable wrapped about the drum, the cable being secured to the drum and coupled to a gantry. A drive system for rotating the drum and first and second braking systems for selectively stopping drum rotation are also included.

The primary motor of the crane provides power to a series of hydraulic pumps that supply pressurized fluid to the hydraulic motor of the drive system. The hydraulic motor is operably coupled to the drum for bidirectionally rotating the drum in both a winding and an unwinding direction. This motor is capable of providing sufficient torque in both a winding and unwinding direction to wind and unwind the wire cable to and from the drum when the gantry is coupled thereto. When adjustment of the gantry is desired, the crane operator may direct pressurized fluid to the hydraulic motor so that the drum rotates and adjusts the position of the gantry. A first braking system is associated with the hydraulic motor for selectively stopping rotation of the motor and hoist drum to hold the gantry in a desired position. The drive system may also include a hydraulic brake which is capable of selectively inhibiting undesired movement of the drum. A redundant second braking system is provided which is operably coupled to a disc brake rotor that is attached on one side of the hoist drum. This second braking system is capable of automatically applying a braking force to the rotor in the event of a specified condition so as to counteract the unwinding force exerted on the drum and to stop movement of the gantry.

The first braking system may include a first brake, a first brake controller, and a detecting device that monitors the pressure of the hydraulic fluid entering the motor. When the fluid pressure entering the motor reaches a level that indicates the motor is supplying torque at or below predetermined minimum, the controller may direct the first brake to engage, thus stopping rotation of the drum and maintaining the gantry in a given position. The first braking system is preferably self-releasing so that when the fluid pressure entering the motor indicates the motor is supplying torque above the predetermined minimum, the first brake disengages allowing the drum to rotate unimpeded. This allows the first braking system to automatically disengage when adjustment of the gantry is desired and engage when the adjustment is complete.

The hydraulic brake of the drive system may be of conventional design and is located between the hydraulic pumps and the hydraulic motor. The hydraulic brake receives hydraulic fluid which is bound for and returning from the hydraulic motor and may be pressure sensitive. If the pressure of the fluid entering the brake is below a preset minimum (e.g., insufficient to rotate the drum) the hydraulic brake may automatically engage by preventing fluid exiting the motor from passing through. Fluid remaining in the motor cannot exit and inhibits movement of the hydraulic motor, hoist drum, and gantry. If the sensed pressure is above a preset minimum, (e.g., sufficient to rotate the drum) the brake may automatically disengage by allowing fluid exiting the motor to re-enter and pass through to a reserve reservoir. Additional fluid may then enter and provide power to the hydraulic motor. This allows the hydraulic brake to automatically disengage when it is desired to rotate the drum and engage when it is desired to hold the drum in a fixed position.

The second braking system is an emergency or fail-safe system that is generally not used while the hoist system is functioning within normal operating parameters. This system operates independently from both the first braking system and the hoist drive system and may include a second brake, a second brake controller, and a sensing device that monitors the speed of the hoist drum. During normal operation, the speed of the hoist drum should not exceed preset safe operating limits. In the event of a hoist system malfunction, the speed sensor will sense that the rotational speed of the drum is at or above a preset maximum. If the drum speed remains at or above the preset maximum for a predetermined duration the controller will recognize that a "runaway" condition has occurred and will direct the second brake to engage, thus stopping rotation of the drum and preventing the gantry from crashing to the ground.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which.

DETAILED DESCRIPTION OF THE PREFERRED EMBODIMENTS

Figure 1:
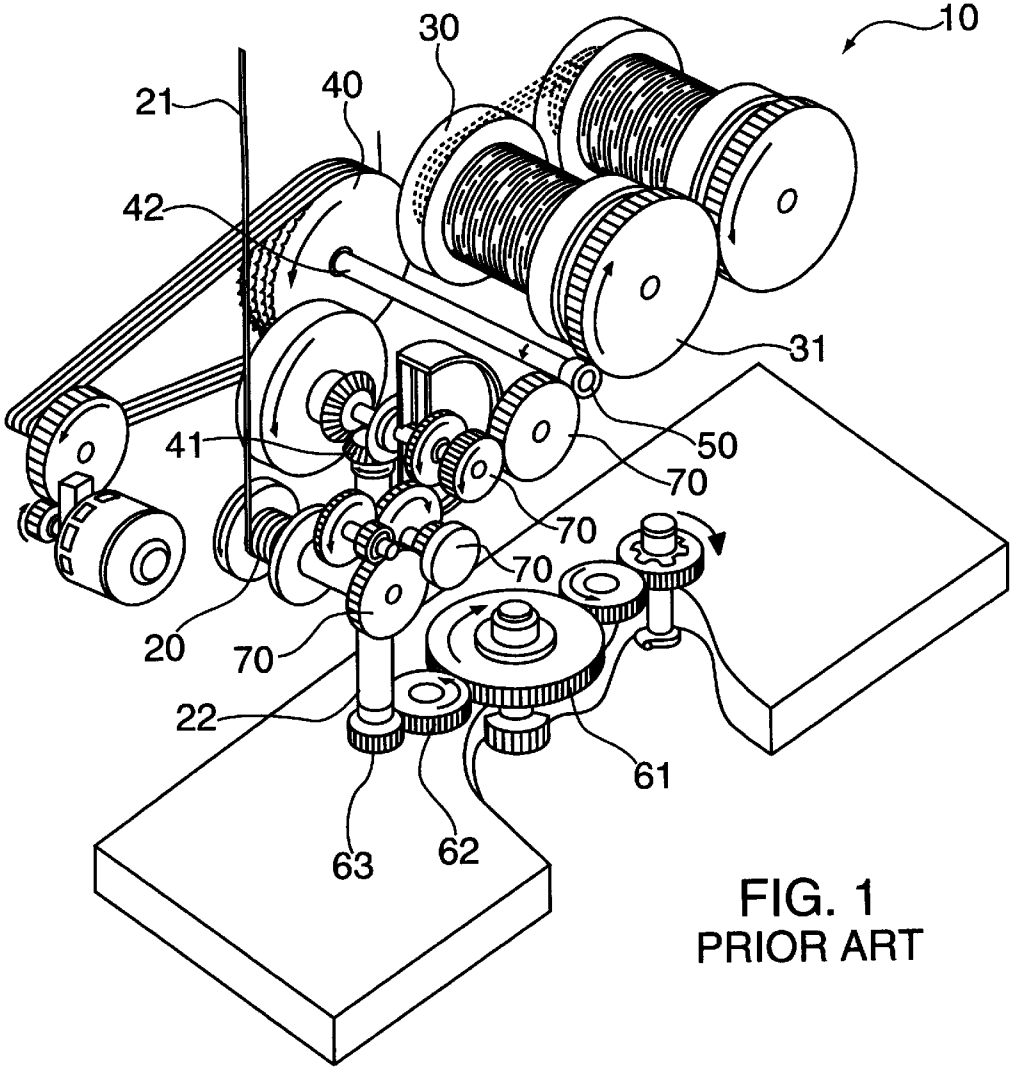
FIG. 1 PRIOR ART
FIG. 1 is an illustrative embodiment of a conventional boom hoist system installed in a lifting crane.
Figure 2:
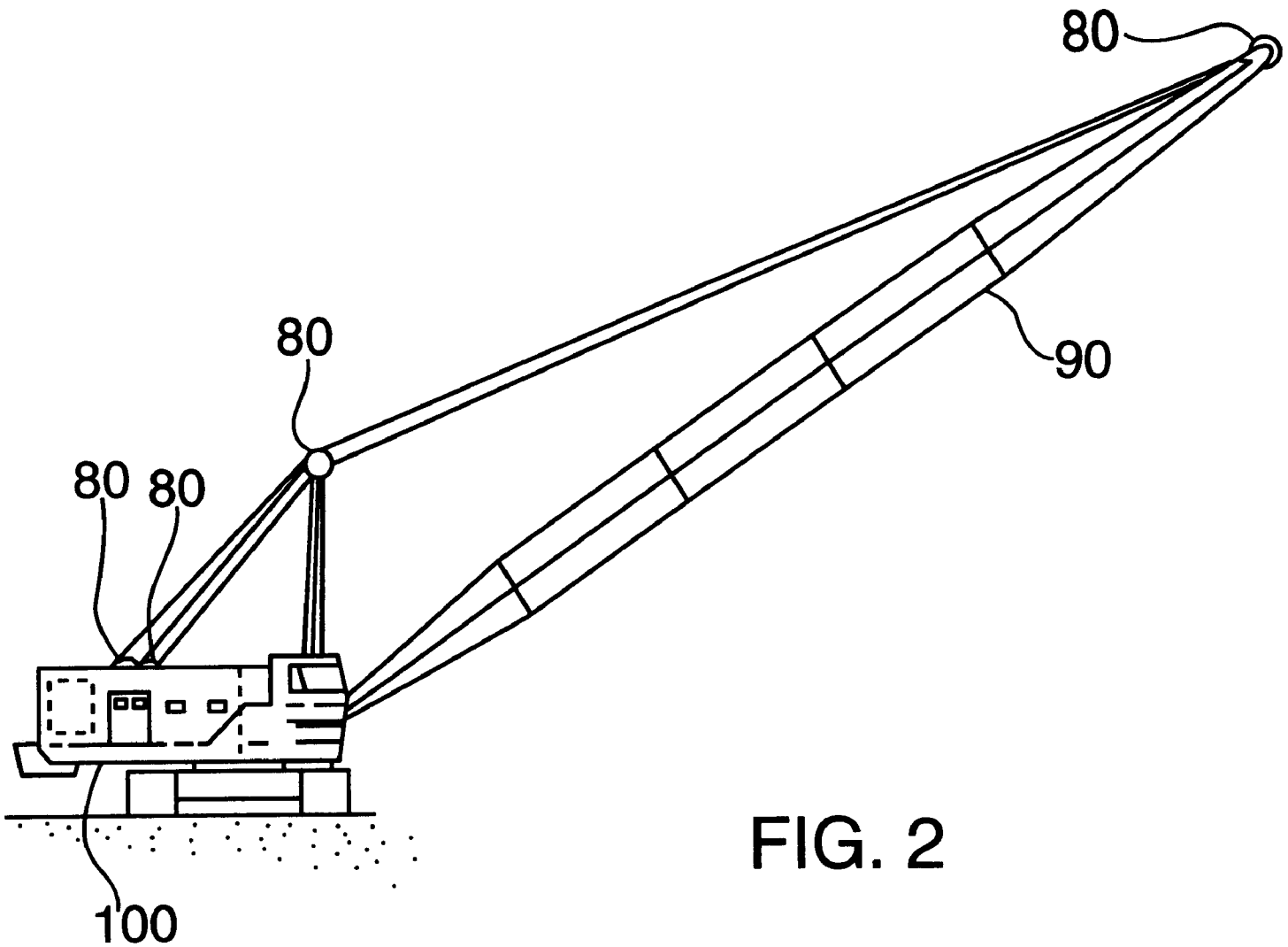
FIG. 2 depicts a lifting crane of conventional design.

FIG. 1 shows a conventional crane hoist system 10 that includes main hoist drum 30 and boom hoist drum 20. Hoist spur gear 31 is mounted on one end of hoist drum 30 and couples directly to one end of drive shaft 42 through spur gear 50. Boom hoist drum 20 couples to drive shaft 42 through spur gear 50 and series of spur gears 70. The opposite end of drive shaft 42 connects to the main drive shaft sprocket 40. The primary motor or "prime mover" of the crane (not shown) connects to vertical translation gear 41 through sprockets 61–63 and shaft 22 for bidirectionally rotating drive shaft 22 and thus boom hoist drum 20. Wire cable 21 is wound around boom hoist drum 20 and frictionally connects to a series of pulleys 80 at its free end for supporting the spanning framework structure of a lifting crane such as gantry 90 (FIG. 2). When hoist drum 20 rotates in the counterclockwise direction as viewed from FIG. 1, wire cable 21 accumulates on it causing the gantry to be raised, thus increasing the mechanical advantage of crane 100. Conversely, when hoist drum 20 rotates in the clockwise direction, wire cable 21 is dispensed from the drum causing the gantry to be lowered. In the hoist system of FIG. 1, the primary motor and its associated drive train function in a conventional manner to dynamically brake and support the gantry, when, for example, it is desired to maintain the gantry at a given position.

One problem associated with conventional lifting cranes like the one shown in FIG. 2 is that they employ hoist systems such as the system depicted in FIG. 1 wherein hoist drum 20 and gantry 90 depend upon a mechanical drive train for support, braking and rotational power. Failure of the primary motor or one of the mechanical drive train components can result in a boom hoist that has no control, or in certain situations, a gantry that suddenly becomes unsupported, causing it to drop uncontrollably.

FIGS. 3–10 illustrate the principles of the present invention for preventing the uncontrolled movement of a hoisted gantry upon failure of the hoist drive mechanism.

Figure 3:
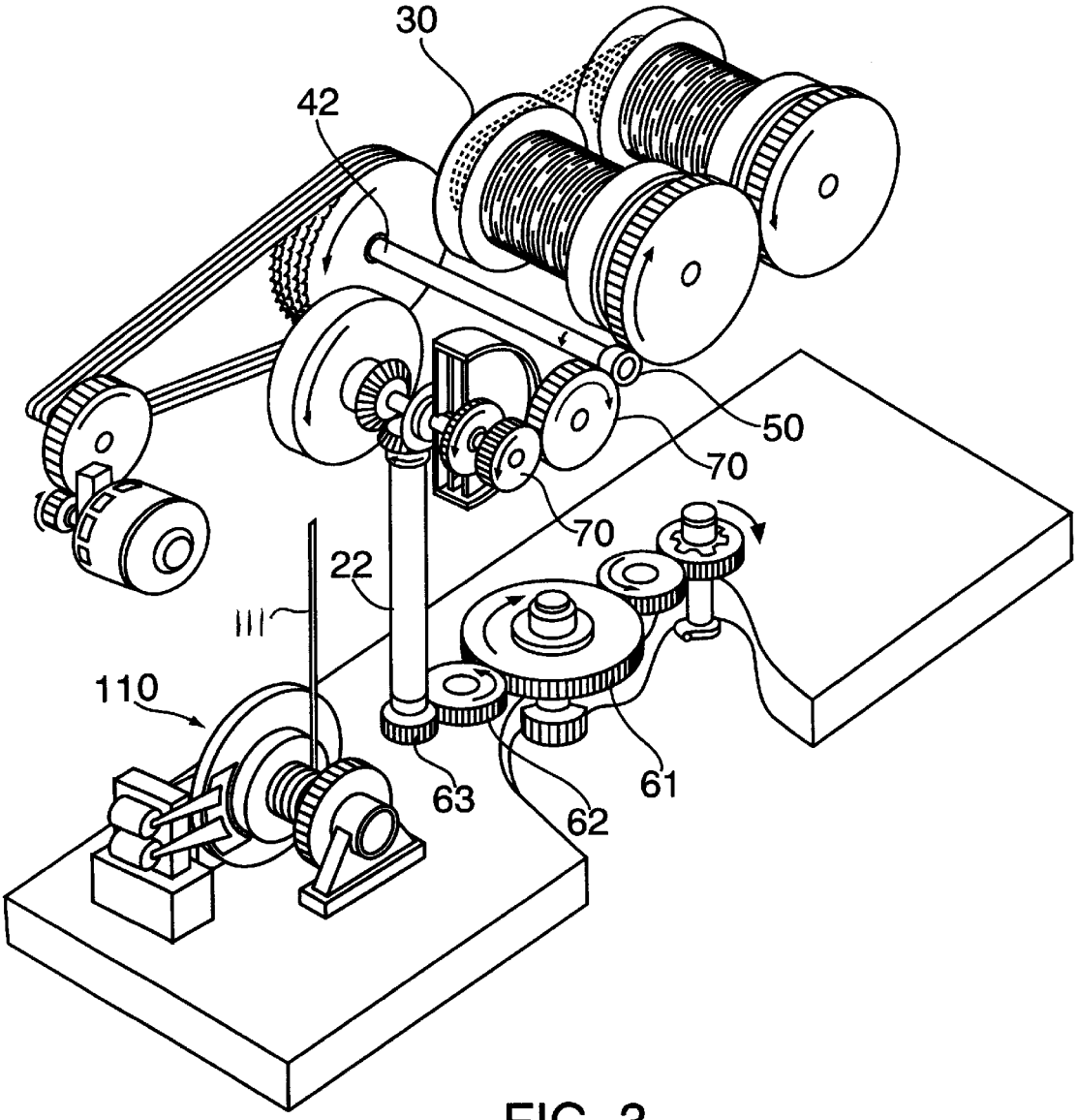
FIG. 3 is an illustrative embodiment of the boom hoist system of the present invention installed in a lifting crane.

FIG. 3 shows a boom hoist system of the present invention installed in a conventional lifting crane such as crane 100. One advantage of this arrangement is that hoist system 110 is separated from the mechanical drive train created by drive shafts 22 and 42, spur gears 50 and 70, and sprockets 61–63. This enables the hoist system of the present invention to operate independently of the crane mechanical works.

Figure 4:
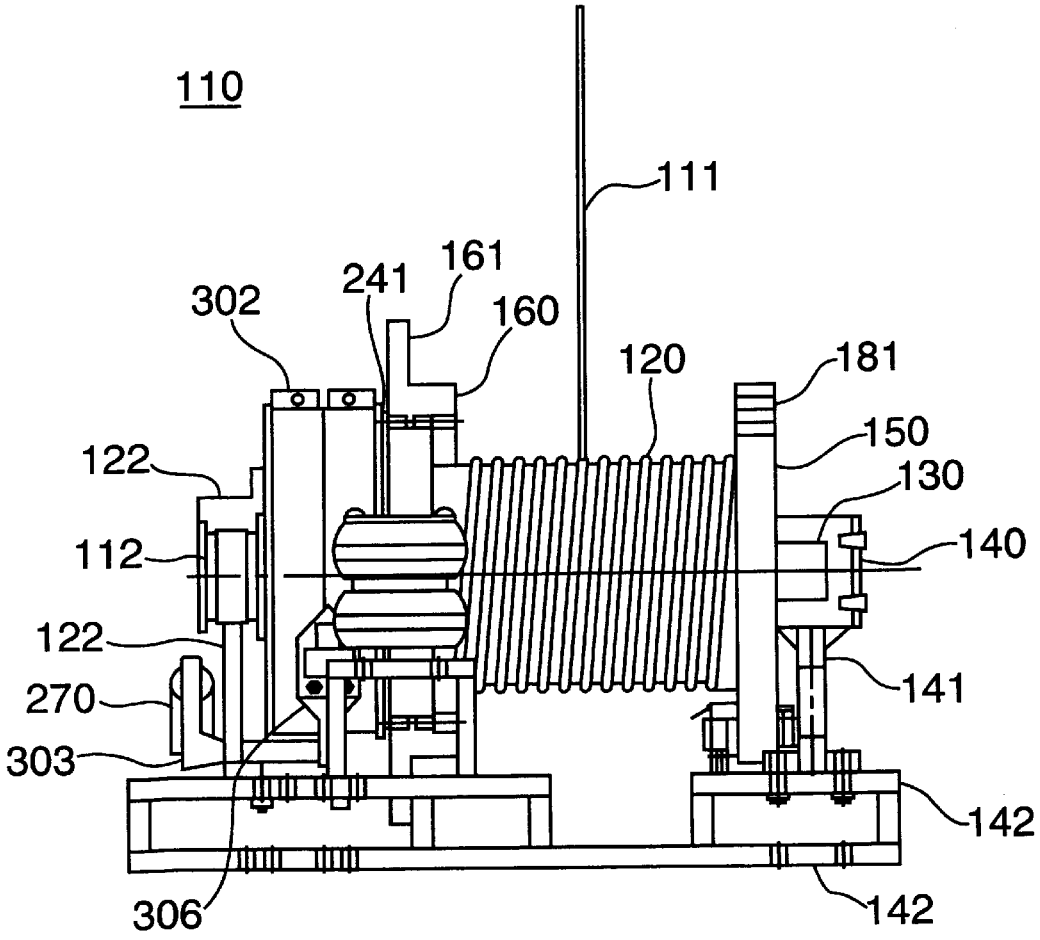
FIG. 4 is a front view of one embodiment of the boom hoist system shown in FIG. 3, constructed in accordance with the principles of the present invention.

In FIG. 4, boom hoist system 110 is shown including cylindrically shaped hoist drum 120 and disk shaped flange sections 150 and 160. The right side of hoist 120 drum is rotatably coupled to bushing assembly 140 by drive shaft 130 that fixedly connects to the center of flange section 150. The left side of hoist drum 120 is coupled to the output side 241 of hydraulic motor 170 (shown in FIG. 6) by flange section 160 which is fixedly connected to output side 241. The motor is capable of bidirectionally rotating hoist drum 120 and in both a clockwise and counterclockwise direction as viewed in FIG. 5.

As shown in FIG. 4, the right hand side of hoist drum 120 is supported by support member 141 which is mounted on base plates 142. The left hand side of the hoist drum is supported by support member 122 which is mounted on base plates 142 at its lower end and connected to the input side 112 of hydraulic motor 170 at its upper end. In operation, hydraulic motor 170 and hoist drum 120 rotate about an axis between fixed input side 112 and bushing assembly 140. When boom hoist system 110 is installed in a lifting crane such as crane 100 (FIG. 2), portions of base plates 142 are attached to the structural frame of the crane (not shown) in order to securely fasten the hoist system to the crane.

Figure 5:
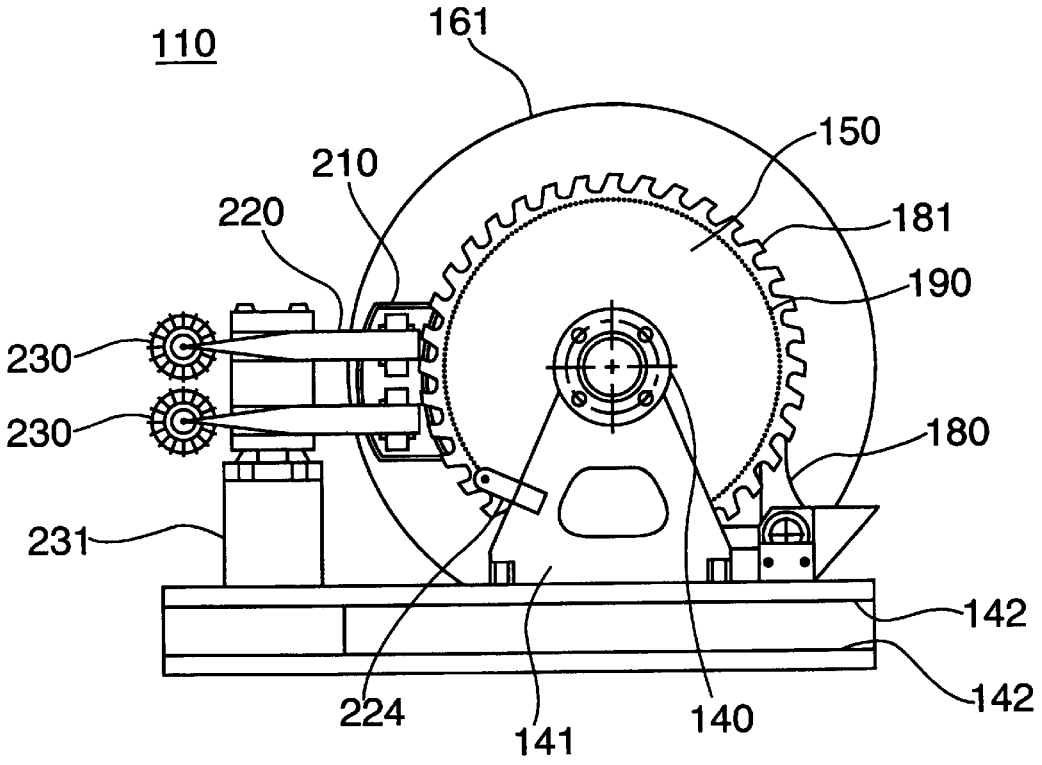
FIG. 5 is a side view of the boom hoist system shown in FIG. 3, constructed in accordance with the principles of the present invention.

As illustrated in FIG. 4, wire cable 111 is wound around hoist drum 120. Flange sections 150 and 160 guide wire cable 111 onto the drum. Pawl notches 181 are disposed about the rim of flange section 150 and may be engaged by pawl pin 180 mounted on base plate 142 in order to lock hoist drum in a given position (FIG. 5). The free end of wire cable 111 frictionally connects (not shown) to a series of pulleys 80 for supporting the spanning framework structure of a lifting crane such as gantry 90 (FIG. 2). When hoist drum 120 rotates in the counterclockwise direction as viewed from FIG. 5, wire cable 111 accumulates on hoist drum 120 causing gantry 90 to be raised, thus increasing the mechanical advantage of crane 100. Conversely, when hoist drum 120 rotates in the clockwise direction, wire cable 111 is dispensed from drum 110 causing the gantry to be lowered. A variety of mechanisms for coupling wire cable 111 to hoist drum 120 and gantry 90 may be employed. For example, a number of systems including force-multiplying blocks may be used. Additionally, one end of wire cable 111 need not be coupled directly to hoist drum 120, and can be coupled to another structure associated with the drum.

Figure 7:
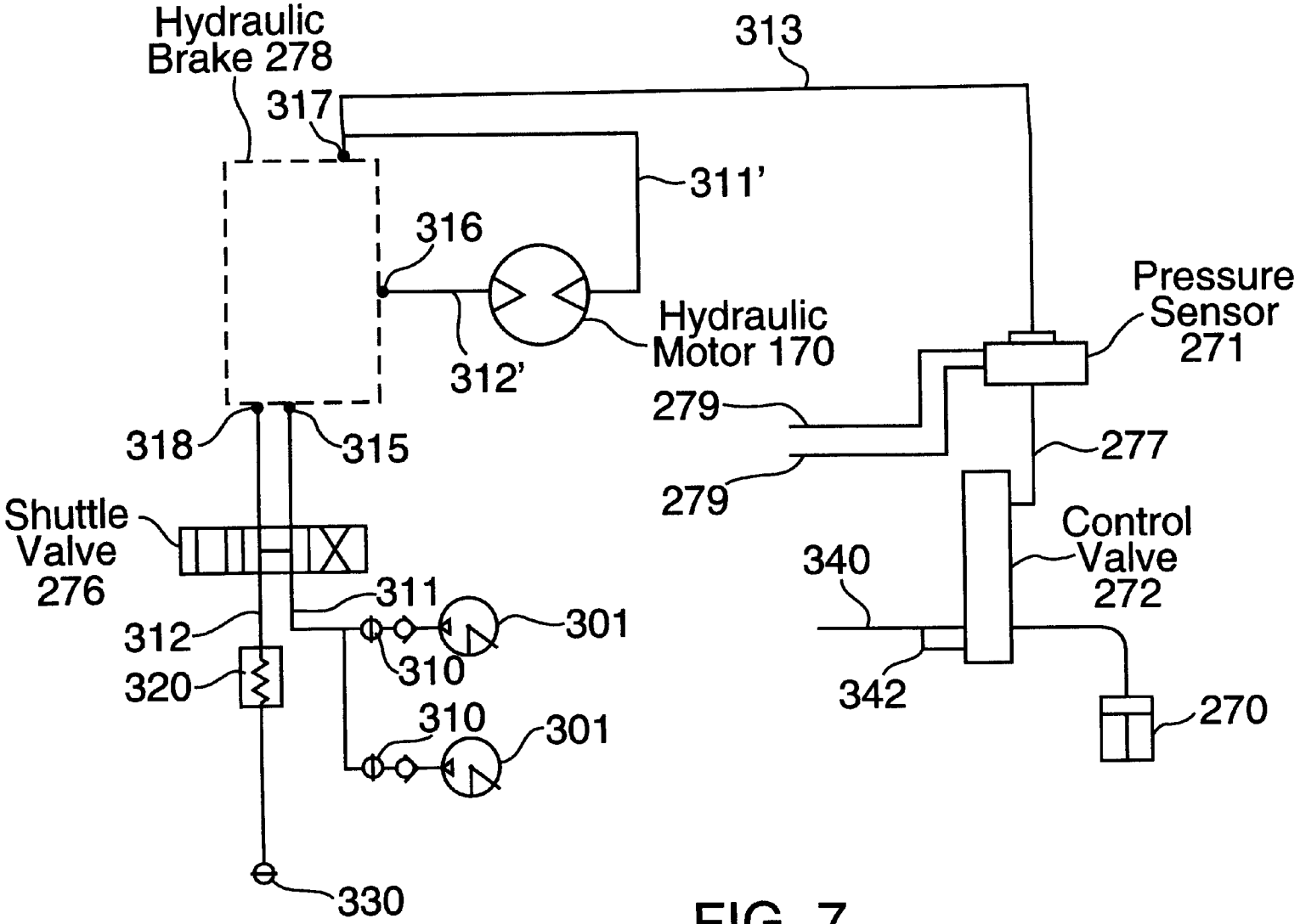
FIG. 7 is a schematic representation of a portion of the present invention.

Referring now to FIG. 7, a schematic representation of the present invention is shown including hydraulic pumps 301 that pressurize the hydraulic fluid used to power motor 170. Hydraulic pumps 301 are connected to and receive power from the main engine or prime mover of the crane (not shown). Pressurized hydraulic fluid travels from pumps 301 through high pressure filters 310 to shottle valve 276 where it is directed either toward hydraulic brake 278 or toward reserve reservoir 330. When the hydraulic fluid is directed the reservoir, it travels from supply conduit 311 to return conduit 312, passes through air cooler 320 and is then deposited in the reserve reservoir 330. When the hydraulic fluid is directed toward hydraulic brake 278, it travels in supply conduit 311 until it enters the hydraulic brake at supply input 315. During adjustment of the gantry, pressurized fluid exits hydraulic brake 278 at supply output 317 and continues to travel in supply conduit 311' until it enters the input of motor 170 where it is used to power the motor. Once motor 170 has used the fluid, it exits motor 170 via return conduit 312' and re-enters the hydraulic brake at return input 316. The hydraulic fluid is allowed to exit brake 278 at return output 318 and travels in return conduit 312 toward reservoir 330. While traveling in return conduit 312 the hydraulic fluid passes through air cooler 320 where excess heat generated by the operation motor 170 is dissipated and then continues on to reserve reservoir 330 where it is recycled for future use by pumps 301.

Hydraulic brake 278 may be of conventional design and may be located either internally or externally to hydraulic motor 170. Hydraulic brake 278 senses the pressure of the hydraulic fluid entering at supply input 315. If the pressure is above a preset minimum, brake 278 is in the "disengaged" mode and allows fluid exiting motor 170 to re-enter and pass through to reserve reservoir 330. If the sensed pressure is below a preset minimum, brake 278 engages by not allowing fluid exiting motor 170 to pass through. This prevents the remaining fluid in motor 170 from exiting, inhibiting movement of both hydraulic motor 170 and hoist drum 120.

Figure 6:
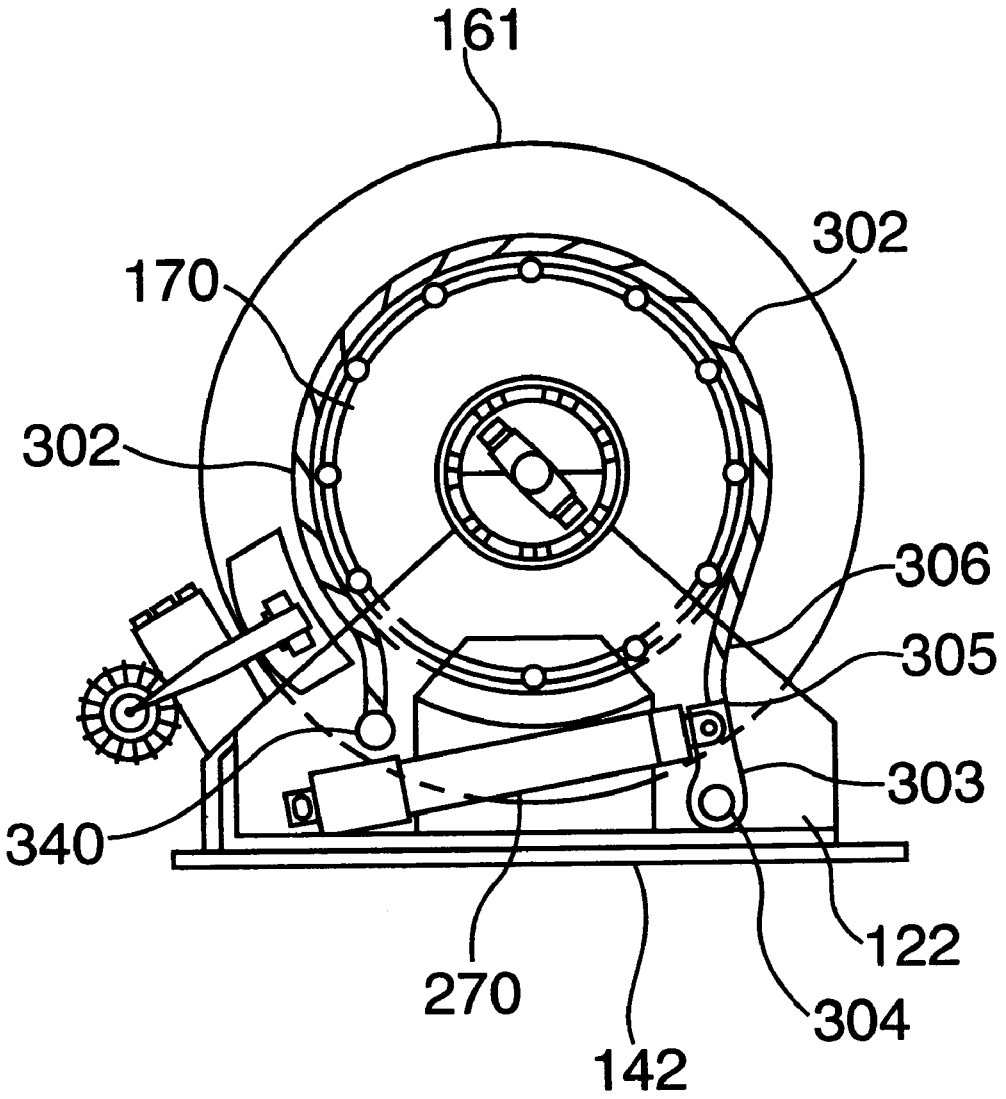
FIG. 6 is a view of the other side of the boom hoist system shown in FIG. 5, constructed in accordance with the principles of the present invention.

In the preferred embodiment depicted in FIGS. 4 and 6, band brake 302 is operably coupled to directly act on hydraulic motor 170. One end of band brake 302 is anchored to base plate 142 or other suitable secure structure associated with the crane or boom hoist assembly. The band brake is wrapped about hydraulic motor 170 from mounting pin 340, as shown in FIG. 6. The other end of band brake 302 is coupled to rocker arm 303, which is mounted on a pivot pin 304 in turn coupled to base plate 142 or other suitable secure structure associated with the crane or boom hoist assembly. Pneumatic actuator 270 including piston arm 305 is coupled to mounting plate 142 in close proximity to hydraulic motor 170. Piston arm 305 is operably coupled to act on rocker arm 303.

Pneumatic actuator 270 may be of conventional design and may include a coil spring in compression that normally biases the internal piston of the actuator so as to move piston arm 305 in an outward direction, away from actuator 270. When the solenoid of control valve 272 (FIG. 7) is directed to release compressed air from the actuator through air vent 342, piston arm 305 expands outwardly. This motion of the piston arm causes rocker arm 303 to rotate about pivot pin 304 in clockwise direction (as shown in FIG. 6) thus pulling free end 306 of the band brake away from the drum, causing it to tightly wrap about and be applied to the rotating surface of hydraulic motor 170. The resulting friction reaction between band brake 302 and the rotating surface of hydraulic motor 170 provides sufficient braking force to stop and prevent movement of gantry 90 as it exerts an unwinding force on wire cable 111. In alternative embodiments, various other suitable braking systems may be employed to provide the braking function of band brake 302. For example, a drum brake of conventional design could be used in place of band brake 302.

As shown in FIG. 7, air pressure can be applied to actuator 270 by directing control valve 272 to connect to compressed air source 340. Sufficient air pressure can be applied so that the force of an internal spring or other biasing element is overcome, so that piston arm 305 moves toward pneumatic actuator 270 causing rocker arm 303 to rotate in a counterclockwise direction, thus releasing band brake 302 from hydraulic motor 170.

In FIG. 7, hydraulic pressure sensor 271 connects to supply conduit 311' via monitor conduit 313 at the input side of hydraulic motor 170. Pressure sensor 271 may be of conventional mechanical or electrical design and can sense the pressure of the hydraulic fluid entering motor 170. Pressure sensor 271 monitors hydraulic fluid pressure and sends a signal via output line 277 to the solenoid of control valve 272 releasing the air pressure of actuator 270 to apply band brake 302 when the sensed pressure of the hydraulic fluid is at or below a preset minimum. This allows band brake 302 to be automatically applied to hoist drum 120 when an adjustment to gantry 90 is complete. For example, when the operator completes an adjustment of gantry 90, hydraulic fluid is redirected from motor 170 to reserve tank 330. Consequently, the pressure of the hydraulic fluid in motor 170 begins to decrease. When the pressure decreases sufficiently, band brake 302 automatically engages in order to counteract the unwinding force exerted on cable 111 by gantry 90. Conversely, when the operator initiates an adjustment, hydraulic fluid is directed toward motor 170 and the sensed pressure begins to increase. When the sensed hydraulic pressure is above a preset minimum, sensor 271 directs control valve 272 to provide compressed air to actuator 270 in order to automatically disengage band brake 302. This allows gantry 90 to be constantly supported while hoist system 110 transitions from drive mode (i.e., rotating with the hydraulic motor supporting the gantry) to brake mode (i.e., not rotating, with the band brake supporting the gantry in a fixed position) and vice versa.

Figure 8:
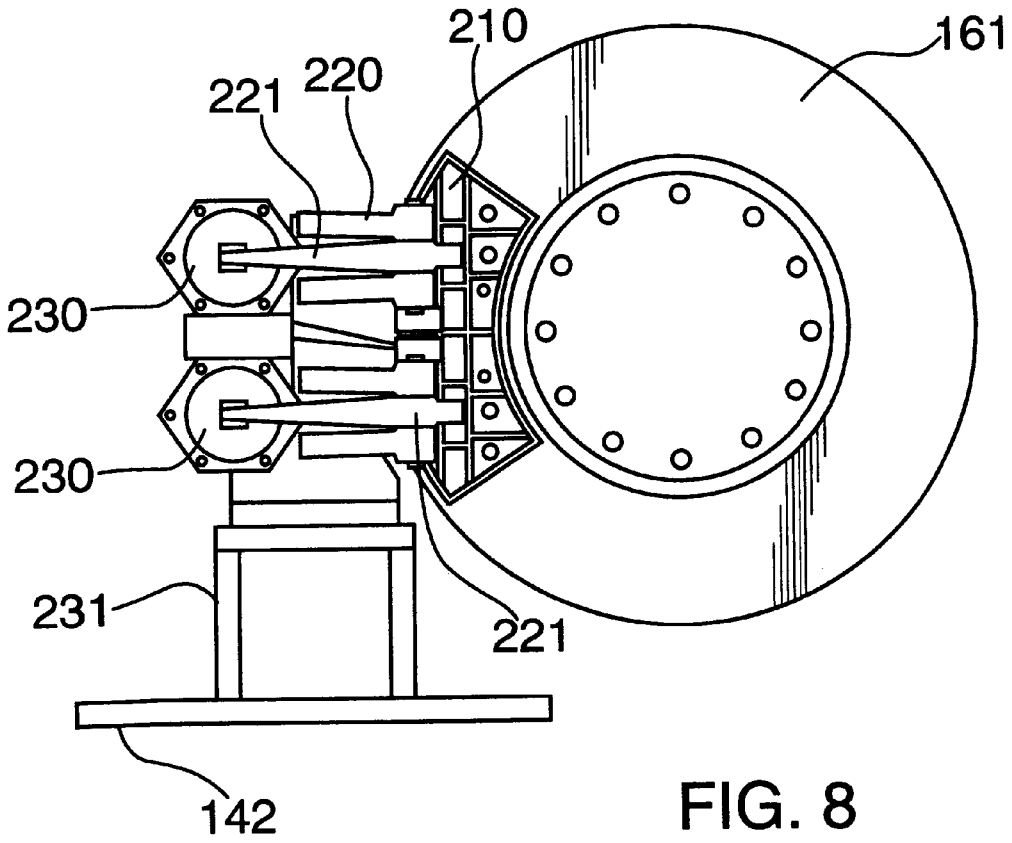
FIG. 8 is an illusive embodiment of a disc brake assembly constructed in accordance with the principles of the present invention.
Figure 9:
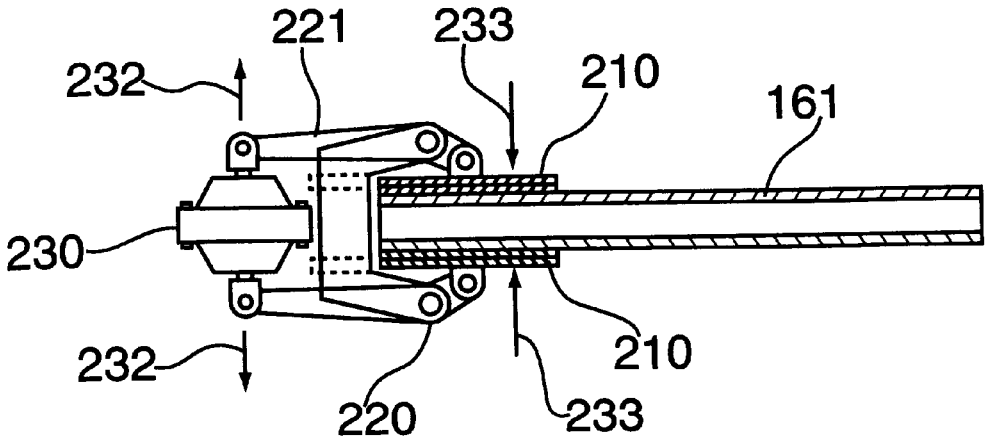
FIG. 9 is a top view of the disc brake assembly shown in FIG. 8.

In the preferred embodiment depicted in FIGS. 4, 5 and 6, disc-shaped brake rotor 161 is coupled directly to flange 160 and is received between caliper 220 forming a disc brake assembly. As shown in FIGS. 8 and 9, disc brake assembly 300 includes a set of pneumatic actuators 230 that are mounted on support members 231 which are in turn mounted on base plate 142. The pneumatic actuators 230 may be of conventional design and may include a coil spring in compression or other element that normally biases the internal piston of the actuator so as to exert a force on the piston in an outward direction, as indicated by arrows 232 in FIG. 9. When control valve 273 (FIG. 10) is directed to release compressed air from the internal pistons through air vent 352, actuators 232 expand, causing caliper arms 221 to push in an inward direction producing the pincing movement indicated by arrows 233 so that brake pads 210 engage rotor 161 on both sides. The resulting friction reaction between rotor 161 and brake pads 210 provides sufficient braking force to stop and prevent movement of gantry 90 as it exerts an unwinding force on wire cable 111.

Figure 10:
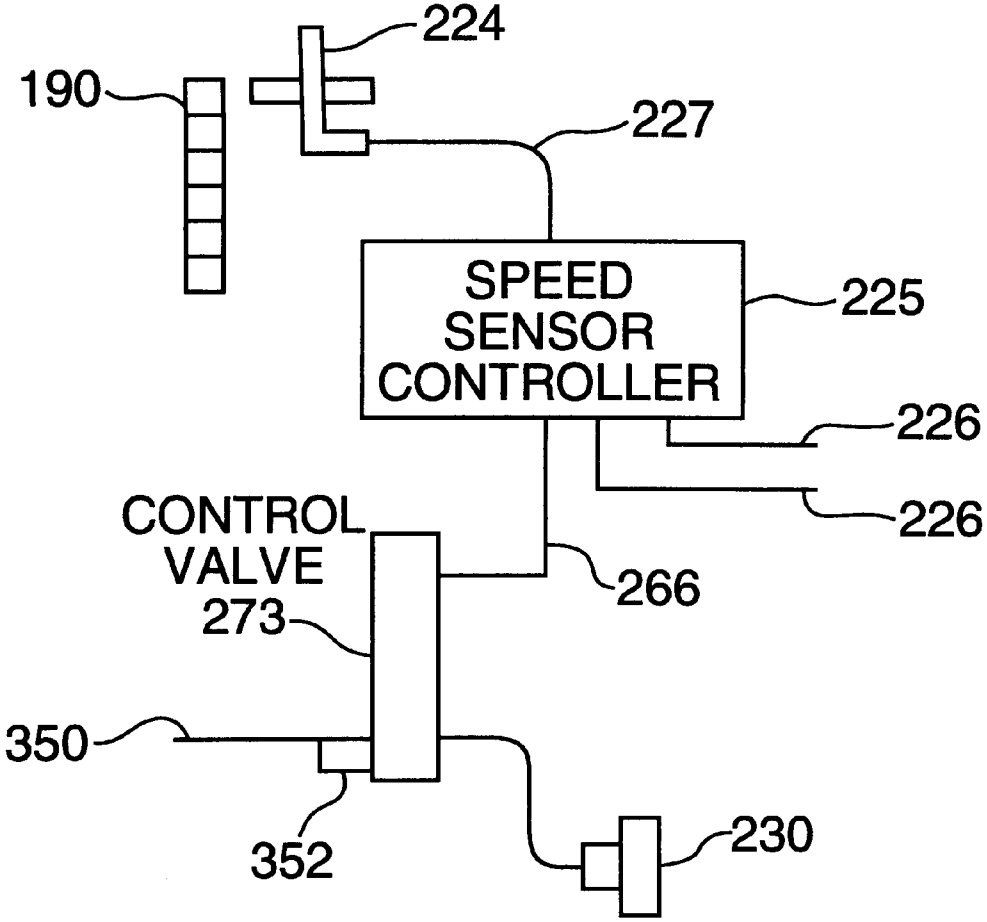
FIG. 10 is a schematic representation of a portion of the present invention.

As shown in FIG. 10, air pressure can be applied to pneumatic actuator 230 from compressed air source 350 through control valve 273. Sufficient air pressure can be applied so that the force of an internal spring or other biasing element is overcome, thus moving actuator 230 in a direction opposite to that indicated by arrows 232 (FIG. 9). As a result, caliper arms 221 move in an outward direction, opposite to that indicated by arrows 233 (FIG. 9), causing brake pads 210 to disengage rotor 161, thus releasing disc brake 300 from hoist drum 120.

As shown in FIG. 5, speed sensor 224 is associated with flange section 150 and can sense the rotational speed of flange section 150 and thus the rotational speed of hoist drum 120. The speed sensor 224 may be of conventional mechanical or electrical design and may include digital or analog encoder circuitry which reads changing flux densities created by sensing holes 190 located near the periphery of flange section 150. The output of speed sensor 224 is delivered via output line 227 to the speed sensor/controller 225 shown in FIG. 10. The speed sensor/controller 225 monitors the speed of hoist drum 120. If the sensed speed of hoist drum 120 exceeds a preset maximum for a predetermined duration, the speed sensor/controller 225 sends a signal via output line 266 to control valve 273. This signal causes control valve 273 to release the air pressure of actuator 230, thus applying disc brake 300. For example, disc brake 300 may be applied when the speed of hoist drum 120 exceeds a preset maximum over a distance greater than one-third of the total circumference of flange section 150 (120° of arc-length). In one embodiment, the braking force caused by engaging disc brake 300 may be significantly greater than that which is required to stop movement of the falling gantry. This decreases the effect the sudden load placed on the disc brake, thereby improving the likelihood of successfully stopping the fall of a runaway gantry. Additionally, once disc brake 300 has engaged, it is preferably not self-releasing when the speed of hoist drum 120 falls below a preset limit. Due to the fail-safe nature of the disc brake, and the possibility of hoist system malfunction, manual input from the crane operator may be required to disengage the disc brake.

As shown in FIGS. 7 and 10, pressure sensor 271 and speed sensor/controller 225 are electrically powered devices and have power input lines 279 and 226, respectively. In the preferred embodiment, power input lines 279 and 226 are connected to an electrical energy storage device (not shown) such as a battery that is in turn connected to the main electrical system of the crane. During normal operation of the crane, speed sensor/controller 225 and pressure sensor 271 operate on power generated by the main electrical system while the batteries charge. However, in the event of an electrical system failure, pressure sensor 271 and speed sensor/controller 225 operate on battery power ensuring that these control systems and their associated braking systems remain active during a failure of the main electrical system.

In operation, pressurized hydraulic fluid continuously travels from pumps 301 to shottle valve 276. If an adjustment of gantry 90 is not desired, the hydraulic fluid is directed to reservoir 330 where it is recycled. When an adjustment is desired, the operator directs pressurized fluid to flow to the input of hydraulic brake 278, which permits the fluid to flow into motor 170. When sufficient hydraulic fluid enters motor 170 it produces a torque that overcomes the load exerted by gantry 90 and begins to rotate, thereby adjusting the position of the gantry. Band brake 302 and hydraulic brake 278 are preferably self-releasing when the hydraulic pressure entering motor 170 is sufficient to rotate hoist drum 120.

When the operator terminates an adjustment of gantry 90, the pressure of the hydraulic fluid entering motor 170 begins to decrease. Hydraulic brake 278 and pressure sensor 272 are pressure sensitive and apply their respective braking systems when the sensed pressure falls below a preset minimum. In the preferred embodiment, band brake 302 and hydraulic brake 278 operate separately from one another and may engage in a serial fashion. For example, pressure sensor 271 may be set to apply band brake 302 at a pressure slightly higher than that required to engage hydraulic brake 278 so that the band brake engages at and below a predetermined low speed of hoist drum 120. This enables band brake 302 to engage first and act as the primary braking system, and hydraulic brake 278 to engage afterward and act as a backup system to ensure proper support for the gantry. It will be understood, however, that the order in which the braking systems are applied may be modified to suit particular needs. For example, hydraulic brake 278 and pressure sensor 271 may be set to trigger at the same pressure, thus engaging band brake 302 and hydraulic brake 278 simultaneously. In this embodiment, the load of the gantry may be distributed between the band brake and the hydraulic brake. Alternatively, hydraulic brake 278 may be set to engage first and band brake 302 may act as the secondary system.

Speed sensor/controller 225 constantly monitors the rotational speed of hoist drum 120 and acts as an independent automatic fail-safe system to apply disc-brake 300 when the drum speed exceeds a preset maximum for a predetermined duration. This ensures that movement of the gantry will be conducted within specified operating parameters and also prevents the gantry from becoming unsupported in the event of a hoist system failure or malfunction. For example, if hydraulic brake 278 and/or band brake 302 fail to engage, or, engage and fail to support the weight of gantry 90, speed sensor/controller 225 will sense the uncontrolled movement and automatically apply disc brake 300. This improves the security of the hoisted gantry by providing an independent redundant braking system that can adequately respond to a sudden failure of the primary drive system and/or braking system.

In the preferred embodiment, speed sensor/controller 225 can be manually overridden if desired by the hoist operator (not shown). For example, speed sensor/controller 225 may be disengaged in order to perform routine maintenance on the boom hoist assembly. Alternatively, the operator may override speed sensor/controller 225 to engage the disc brake upon 300 command (e.g., in an emergency situation).

The present invention has been described in conjunction with preferred embodiments which are presented for illustration and not limitation. One of ordinary skill will readily understand that the invention can be practiced by other than the described embodiments, and that various alterations, changes, and substitutions of equivalents can be made without departing from the spirit and scope of the invention.

We claim:

1. A boom hoist system for lifting cranes comprising:

a drum;

a drive system coupled to said drum which is capable of rotating said drum;

a first braking system associated with the drive system;

a speed sensor for sensing the rotational speed of the drum; and a second braking system associated with the drum that automatically stops rotation of the drum when the speed sensor senses that the rotational speed of the drum is at or above a predetermined limit for a predetermined period of time.

2. The boom hoist system defined in claim 1 wherein said drive system further comprises a drive system brake configured to automatically inhibit rotation of the drum when the drive system provides a torque substantially insufficient to rotate the drum.

3. The boom hoist system defined in claim 2 wherein said drive system brake further comprises a release mechanism that allows said drive system brake to be self-releasing when said drive system applies a substantially sufficient torque to rotate the drum.

4. The boom hoist system of claim 2 wherein the drive system brake is a hydraulic brake.

5. The boom hoist system defined in claim 1 wherein the first braking system further comprises a monitoring device that monitors a torque supplied to said drum; the first braking system automatically engaging when said monitoring device senses that said torque is substantially insufficient to rotate the drum.

6. The boom hoist system defined in claim 5 wherein said first braking system automatically disengages when said monitoring device senses that said torque is substantially sufficient to rotate the drum.

7. The boom hoist system of claim 5 wherein said first braking system includes a band brake.

8. The boom hoist system defined in claim 1 wherein the second braking system is responsive to the output of the speed sensor.

9. The boom hoist system of claim 8 wherein said second braking system includes a disc brake.

10. The boom hoist system of claim 9 wherein the second braking system further comprises a manual control device so that said second braking system can be manually overridden to engage and disengage the second braking system.

11. The boom hoist system of claim 1 wherein said second braking system includes a disc brake.

12. The boom hoist system of claim 11 wherein the second braking system further comprises a manual control device so that said second braking system can be manually overridden to engage and disengage the second braking system.

13. The boom hoist system defined in claim 1 wherein said drive system operates independently of a crane mechanical drive train.

14. The boom hoist system defined in claim 1 wherein the drive system is a hydraulic drive system.

15. The boom hoist system defined in claim 1 wherein said second braking system operates independently of the first braking system and the drive system.

16. A method of preventing a hoisted gantry supported by a boom hoist system from falling uncontrollably, the boom hoist system including a drum, a wire cable wrapped about the drum with one end attached to the drum and the other coupled to the gantry, a drive system, a drive system brake, a first braking system, a speed sensor, and a second braking system, said method comprising:

monitoring the torque applied to said drum;

engaging the first braking system to inhibit the drum from rotating when the monitored torque is at or below a predetermined minimum; and engaging the drive system brake to inhibit the drum from rotating when the monitored torque is at or below a predetermined minimum.

17. The method of claim 16 further comprising:

monitoring the rotational speed of the drum with said speed sensor.

18. The method of claim 17 further comprising:

engaging the second braking system in order to stop the drum from rotating if the monitored speed is at or above a preset maximum.

19. The method of claim 17 further comprising:

engaging the second braking system in order to stop the drum from rotating if the monitored speed is at or above a preset maximum for a predetermined duration.

20. A method of adjusting the position of a hoisted gantry with a boom hoist system, the boom hoist system including a drum, a wire cable wrapped about the drum with one end attached to the drum and the other end coupled to a gantry, a drive system, a drive system brake, and a first braking system, said method comprising:

directing the drive system to apply sufficient rotational torque to the drum such that the drum rotates;

disengaging the first braking system to allow the drum to rotate when said sufficient rotational torque is applied to the drum from the drive system;

disengaging the drive system brake to allow the drum to rotate when said sufficient rotational torque is applied to the drum from the drive system; and rotating the drum to accumulate the wire cable on and to dispense the wire cable from the drum to adjust the position of the gantry.

21. The method of claim 20 further comprising:

monitoring rotational torque applied to the drum from the motor.

22. The method of claim 21 further comprising:

directing the drive system to apply substantially no rotational torque to the drum when the gantry has reached a desired position;

engaging the first braking system in order to stop the drum from rotating when the monitored torque is at or below a preset minimum;

engaging the drive system brake to further inhibit the drum from rotating when the monitored torque falls below a preset minimum.

23. A boom hoist system for lifting cranes comprising:

a drum;

a gantry operably coupled to said drum;

a drive system coupled to said drum which is capable of rotating said drum;

a first braking system associated with the drive system;

a speed sensor for sensing the rotational speed of the drum; and a second braking system associated with the drum for automatically stopping rotation of the drum when said speed sensor senses that the rotational speed of the drum is at or above a predetermined limit.

24. The boom hoist system defined in claim 23 wherein said drive system operates independently of a crane mechanical drive train.

* * * * *